United States Patent [19]

Tamada et al.

[11] Patent Number: 4,553,123

[45] Date of Patent: Nov. 12, 1985

[54] MINIATURE INDUCTOR

[75] Inventors: Minoru Tamada; Takashi Kumokawa; Ichiji Shimamoto, all of Nagaokakyo, Japan

[73] Assignee: Murata Manufacturing Co., Ltd., Japan

[21] Appl. No.: 414,666

[22] Filed: Sep. 3, 1982

[51] Int. Cl.[4] ..... H01F 15/10

[52] U.S. Cl. ..... 336/83; 336/192; 336/221; 336/233

[58] Field of Search ..... 336/83, 212, 216, 221, 336/223, 233, 192; 140/105; 339/276 R

[56] References Cited

U.S. PATENT DOCUMENTS

| | | | |
|---|---|---|---|
| 2,786,983 | 3/1957 | Hill | 336/83 |
| 3,028,570 | 4/1962 | Taylor | 336/83 |
| 3,701,961 | 10/1972 | Folk | 336/192 |
| 3,743,853 | 7/1973 | Dittman et al. | 336/83 |
| 4,004,251 | 1/1977 | Hesler et al. | 336/83 X |

FOREIGN PATENT DOCUMENTS

| | | | |
|---|---|---|---|
| 5574013 | 11/1978 | Japan . | |
| 694559 | 7/1953 | United Kingdom | 336/83 |
| 967508 | 8/1964 | United Kingdom | 336/83 |
| 1407501 | 9/1975 | United Kingdom | 336/83 |

*Primary Examiner*—Reinhard J. Eisenzopf

*Attorney, Agent, or Firm*—Ostrolenk, Faber, Gerb & Soffen

[57] ABSTRACT

A miniature inductor used as a boosting coil in a piezoelectric buzzer drive circuit or the like is disclosed. The inductor has a closed magnetic circuit core formed of two cores covering the outer periphery of a coil wound around inner coil-cores. A pair of cutout windows are provided at the outer periphery of each of the cores, and joint plates are disposed on the inner bottom surface of one core. Terminal blocks project outwardly therefrom, so that the terminal blocks are adapted to be folded over each other. The end of each lead wire of the coil is guided through the cutout window and sandwiched between the folded terminal blocks, thereby connecting therewith.

11 Claims, 13 Drawing Figures

MINIATURE INDUCTOR

BACKGROUND OF THE INVENTION

1. Field of the Invention

This invention relates to an improvement in a miniature inductor used as a boosting coil in a piezo-electric buzzer drive circuit for a wrist watch or a desk electronic computer or the like.

2. Description of the Prior Art

A conventional miniature inductor used as the boosting coil, as shown in FIGS. 1 and 2, is so constructed that two bowl-shaped cores 22 and 23, which are provided at both peripheral positions opposite to each other with a pair of cutout windows 21 respectively, cover a coil 24 wound around the coil-cores at the cores 22 and 23 and are vertically assembled to form a closed magnetic circuit core, on the inner bottom surface of one core 23 is disposed a terminal plate 26 provided at both ends thereof with conductive patterns 25 and projecting at both ends outwardly through the windows 21, the ends 27 of lead wires of coil 24 being drawn out from the windows 21 respectively, so that the lead wire ends 27 are wound onto the conductive patterns at both ends of the terminal plate 26 respectively.

In the conventional miniature inductor, the terminal plate 26 is formed of an insulating material, such as BT resin or glass-epoxy resin,, smaller in thickness, and is stuck at the portion projecting from the core with copper foil to provide conductive patterns 25, end portions of lead wires of coil 24 are wound onto the conductive patterns 25, and the lead wire wound portions are soldered to connect the terminal plate 26 with the lead wire ends 27.

Therefore, the use of insulating material for the terminal plate 26 is advantageous in that a miniature inductor can be manufactured which employs its core material, for example, Mn-Zn series ferrite, and gains a relatively larger inductance. Disadvantageously, however, the thin terminal plate provided with the conductive patterns of copper foil or the like is liable to be broken or bent in itself due to vibrations or an impact, thereby being defective in that the broken or bent terminal block causes disconnection of an extremely fine lead wire.

Therefore, it is difficult to use an automatic insertion machine which utilizes a part feeder to mount the inductor on a printed circuit board, and also the conventional process, in which the lead wire has to be wound around the terminal plate at the miniature inductor having the core of about 2 to 5 mm in diameter, is complex and problematical in practical use and in manufacture.

SUMMARY OF THE INVENTION

An object of the invention is to provide a miniature inductor in which the lead wire cannot easily be disconnected by application of an external force, at the joint of the lead wire end and terminal plate.

Another object of the invention is to provide a miniature inductor which is automatically mountable on a printed circuit board by use of a part feeder or the like.

Still another object of the invention is to provide a miniature inductor which can considerably improve the joint work between the terminal plate and the lead wire ends so as to lead to a low manufacturing cost.

These and other object are accomplished by the inductor of the invention which includes a closed magnetic circuit core having an outer core enclosing a coil space and an inner coil core located in the coil space. A coil comprising at least one wire is wound around the inner coil core, and each of a plurality of lead wires extends out of the coil space through a respective window defined in the outer core. For each window, a plate is mounted to the magnetic circuit core with a terminal extending outward from the respective window. Each terminal has a flat portion and a bent portion which may be bent in relation to the flat portion for holding the respective lead wire between the flat and bent portions.

These and other objects, features and advantages of the invention will become more apparent upon a reading of the following detailed specification and drawings.

DETAILED DESCRIPTION OF THE PREFERRED INVENTION

Figure 1:
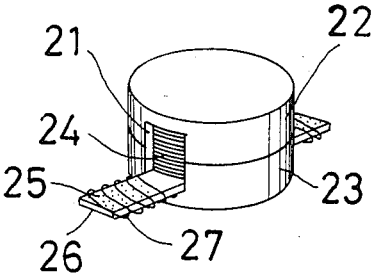
FIG. 1 PRIOR ART
FIG. 1 is a perspective view of the conventional miniature inductor.
Figure 4:
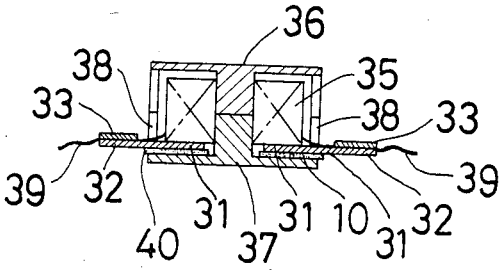
FIG. 4 is a longitudinally sectional view of the miniature inductor in FIG. 3.
Figure 2:
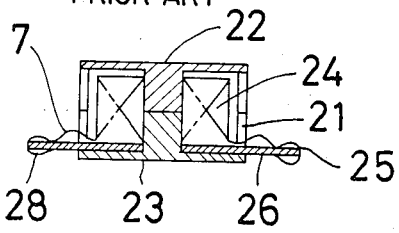
FIG. 2 PRIOR ART
FIG. 2 is a longitudinally sectional view of the miniature inductor in FIG. 1.
Figure 5:
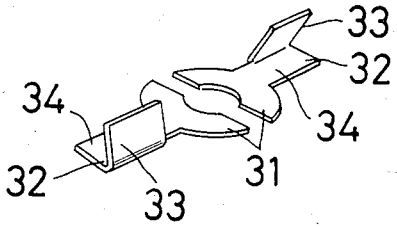
FIG. 5 is a perspective view of joint plates used in the miniature inductor of the invention.

The first embodiment of the miniature inductor of the invention shown in FIGS. 3 through 6, employs a pair of joint plates 31 of a cut-in-half-ring-like shape, each joint plate 31 being connected at its outer periphery to a terminal block 32 as shown in FIG. 5.

The respective joint plates 31 integral with the terminal block 32 are formed of elastic metal, such as nickel silver, brass, copper or iron, each terminal block 32 having at at least one side edge thereof a bent portion 33 integral with the terminal block 32 and at at least one surface a solder layer 34.

The solder layer 34 is adhered to the terminal block 32 by means of solder-plating or immersion into molten solder, which need only be attached on at least one surface onto which the bent portion is to be folded. Alternatively, the solder layer 34 may coat overall each joint plate 31 including the terminal block 32.

Figure 3:
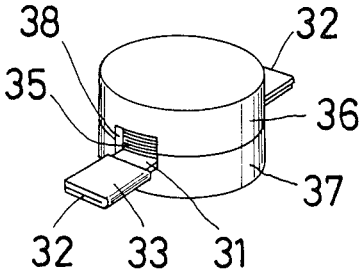
FIG. 3 is a perspective view of a first embodiment of a miniature inductor of the invention.
Figure 6:
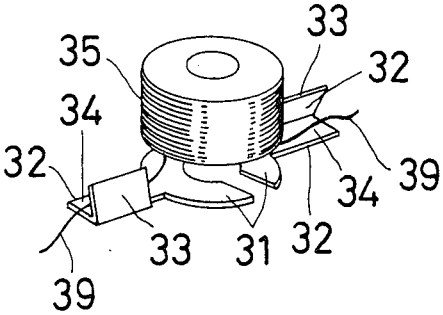
FIG. 6 is a perspective view of an assembly of a coil and the joint plates in the miniature inductor in FIG. 3.

The miniature inductor of the first embodiment, as shown in FIGS. 3 and 4, comprises the pair of joint plates 31 and bowl-like-shaped cores 36 and 37 which are adhered to each other and encase therein a coil 35 wound around a coil-core at the center of each core 36 and 37.

The pair of joint plates 31, as shown in FIG. 4, are inserted into one bowl-like-shaped core 37 and disposed on the inner bottom surface thereof, the terminal blocks 32 each projecting at one end outwardly through a pair of cutout windows 38 opposite to each at the outer periphery of the core 37. In addition, the joint plates 31 are preferably fixed to the inner bottom surface of the core 37 by use of an adhesive such as epoxy resin.

Lead wire ends 39 of coil 35 encased within the cores 36 and 37 are drawn out from the windows 38 and sandwiched between the flat portion of terminal block 32 and the bent portion 33 thereof, so that the wire end sandwiching portions are heated to melt the solder layers, thereby connecting the terminal blocks 32 with the lead wire ends 39 respectively.

The coil 35 incorporated in the cores 36 and 37 employs a wire having coating material of the self-fusion-deposition property and usually of a diameter of about 10 to 70$\mu$, and is previously coiled to have a central cavity.

In detail, a coating material for the wire employs polyurethane provided at the outer periphery with a fusion-deposition agent in nylon series, epoxy series or the like, a current flows into the coil 35 after completed, and the fusion-deposition agent at the outer periphery is heat-molten to stick the coating, or the wire is coiled in condition of melting the fusion-deposition agent by an organic solvent or the like, thus completing the coil 35.

As seen from the above, in a case where the coating material is formed of polyurethane or the like having a heat-molten property, the wire end of coil 35, even when coated, can be connected by soldering to the terminal block 32 without hindrance, in which there is no need of previously removing the coating from the wire ends.

Also, the miniature inductor of the invention, which particularly uses the metallic joint plates, can put into practical use the joint plates 31 disposed directly on the inner bottom surface of core 37 when the cores 36 and 37 are formed of a material, such as Ni-Zn series ferrite, of large resistivity.

However, in a case that the cores 36 and 37 are formed of a material, such as Mn-Zn series ferrite, of small resistivity, an insulating material 40, such as an insulating adhesive, is interposed between the respective joint plates 31 and the inner bottom surface of core 37 and both side edges of each window 38, thereby insulating the joint plates 31 from the core 37.

Next, explanation will be given with respect to a second embodiment shown in FIGS. 7 and 8.

The miniature inductor of the first embodiment comprises the pair of cores 36 and 37 which form the closed magnetic circuit core, and the bent portions 33 projecting entirely outwardly from the core 37.

Figure 7:
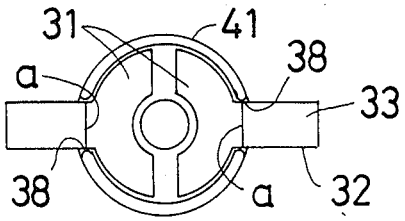
FIG. 7 is a plan view of a second embodiment of a miniature inductor of the invention, showing a core and the joint plates.

The second embodiment combines a bowl-like-shaped core 41 with a plate-shaped core 42 so as to form a closed magnetic circuit core, and the inner edge a of each bent portion 33 folded onto the terminal block 32 is positioned not to project outwardly from the window 38 as shown in FIG. 7.

In the case that each bent portion 33 is positioned as foregoing, each lead wire end 39 extending from the coil 35 to the terminal block 32 is not exposed to the exterior of core 41, whereby there is the advantage in preventing the occurrence of disconnection at a portion of lead wire between the coil 35 and the inner edge a of each bent portion 33. Furthermore, each window 38 at the core 41 is planed off to be round at both side edges as shown in FIG. 7, thereby preventing the lead wire ends from being disconnected even when contacting the edges.

Figure 8:
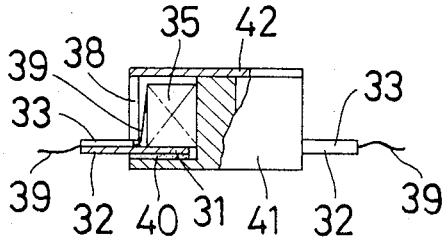
FIG. 8 is a partially cutaway front view of the second embodiment in FIG. 7.

In addition, an insulating material 40 in the FIG. 8 embodiment of course is not necessary when the cores 41 and 42 are formed of material, such as Ni-Zn series ferrite, of high resistivity. Usually, ferrite of high resistivity is used and the insulating material is omitted in order to miniaturize the inductor. Alternatively, the bowl-shaped and plate-shaped cores 41 and 42 in combination may be substituted by both bowl-shaped cores.

Figure 9:
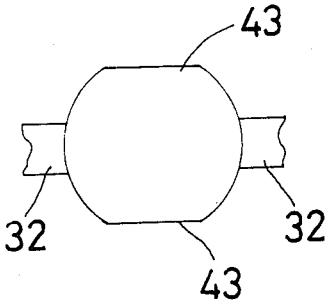
FIG. 9 is a plan view of a third embodiment of a miniature inductor of the invention.

In a third embodiment shown in FIG. 9, flat portions 43 are formed opposite to each other at the outer periphery of the cores 36 and 37 or cores 41 and 42 to allow the build-in machine to operate its part-feeder in alignment, thereby enabling automatic insertion of the inductor into the printed circuit board.

Figure 10:
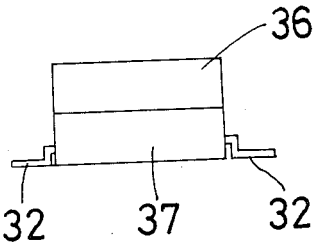
FIG. 10 is a front view of a fourth embodiment of a miniature inductor of the invention, in which joint plates are subjected to the bending process.

In a fourth embodiment shown in FIG. 10, each terminal block 32 is bent at an intermediate portion of the projecting portion of block 32 from the core 37 and is substantially leveled at the lower surface of block 32 with the outer bottom surface of core 37. As a result, the miniature inductor, when placed on the printed circuit board, is mountable directly to conductors thereon.

Figure 12:
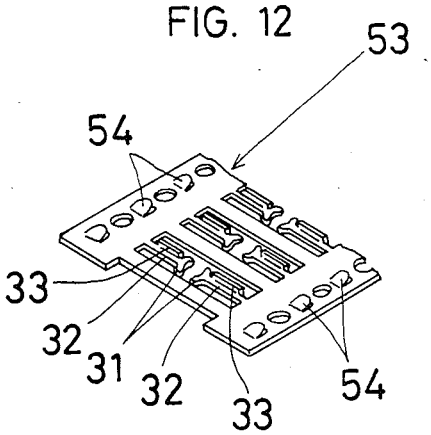
FIG. 12 is a perspective view of a frame-like-shaped terminal block provided with a number of joint plates in alignment.
Figure 13:
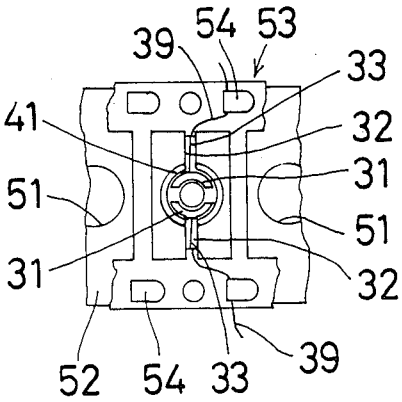
FIG. 13 is a plan view of the core fitted into the jig and frame-like-shaped terminal block, in condition of being assembled.

Next, explanation will be given on the build-in process of the miniature inductor in accordance with FIGS. 11 through 13.

Figure 11:
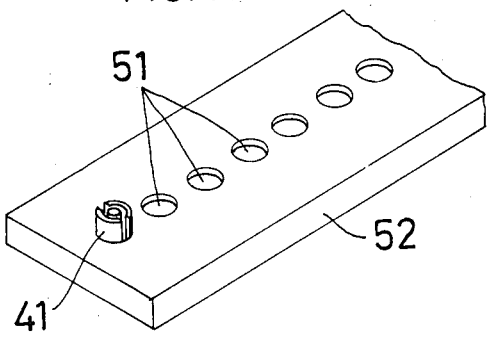
FIG. 11 is a perspective view of a core in condition of being fitted into a jig during the assembly of the miniature inductor.

At first, a jig 52 is prepared which is provided at the surface with recesses 51 disposed at regular intervals as shown in FIG. 11, so that the bowl-shaped cores 41 can be fitted into respective recesses 51. On the other hand, a terminal block frame 53 formed of a metallic plate of nickel silver or the like is punched at regular intervals to form a number of joint plates 31 as shown in FIG. 13.

The bowl-shaped cores 41 are fitted into respective recesses 51 of the jig 52 and the terminal block frame 53 is placed on the cores 41, so that opposite joint plates 31 are fitted into each core 41, and each terminal block 32 is allowed to project outwardly from the bowl-shaped core 41 through each window 38. Then, each separate coil 35 is fitted around the central coil-core of core 41 keeping the joint plate 31 in contact with the inner bottom surface of core 41.

The ends 39 of both lead wires are drawn out from the coil 35 through the windows 38 and pass between the flat portion of each terminal block 32 and the bent portion 33 thereof and retained to in respective retainers 54 provided on either side of terminal block frame 53 respectively.

Next, the flat portion of each terminal block 32 and bent portion at the side edge thereof are held between the electrodes of an electric spot welder not shown, the bent portion 33 being folded so as to sandwich the lead wire end between the flat portion and bent portion of terminal block 32, and simultaneously a current flows therein and heats the sandwiched portion, thereby soldering the lead wire end 39 with the terminal block 32 by fusing the solder layer previously provided.

Thereafter, a small amount of adhesive of low viscosity is applied on the central coil-core and the upper edge of the peripheral wall of bowl-shaped core 41 and is allowed to permeate between the coil 35 and the bowl-shaped core 41, the coil 35 and the joint plates 31, and the joint plate 31 and the inner bottom surface of bowl-shaped core 41, the adhesive being, for example, epoxy series adhesive such as UNISET ®, A-312 (article No.) sold by AMICON Corporation.

Next, the plate-shaped core 42 is placed on the bowl-shaped core 41 with the pair of cores 41 and 42 by being pressed together using an elastic member. The cores are heated in this condition to harden the adhesive, and then excess portions, other than the terminal blocks 32, are cut off from the terminal block frame 53, thereby completing the miniature inductor.

Incidentally, the windows 38 may be filled with an adhesive after assembly and subjected to water-proofing or insulation process.

In this case, the adhesive used should have a high viscosity so that it will not flow down and stick to the terminal block 32. One such adhesive is UNISET ®, D-275 (article No.) sold by AMICON Corporation.

As seen from the above, the miniature inductor of the present invention, in which the lead wire ends of the coil encased in the cores are guided outwardly through the windows and held between the terminal blocks of each joint plate, cannot have its lead wire easily disconnected by external forces, with the result that a part feeder can be used to automatically mount the inductor on a printed circuit board. Also, since the troublesome step of winding the lead wire onto the terminal block is not required, the manufacturing process is simplified.

Furthermore, in the conventional inductor makes the terminal plate is made as thin as possible to avoid an increase in height thereof. This is disadvantageous, however, since the terminal plate is reduced in strength. In contrast, the inductor of the invention has the terminal block folded in layers and therefore has considerably improved strength. This makes it possible to reduce the thickness of the plate material for the terminal block.

Although, serveral embodiments have been described, they are merely exemplary of the invention and not to be constructed as limiting, the invention being defined solely by the appended claims.

What is claimed is:

1. An inductor, comprising:

a closed magnetic circuit core comprising an outer core for substantially enclosing a coil space, said outer core having defined therein a plurality of windows; said closed magnetic circuit core further comprising an inner coil core located in said coil space;

at least one coil in said coil space wound around said inner coil core; said coil comprising at least one wire having a plurality of lead wires, each lead wire extending out of said coil space through a respective one of said windows; and a plurality of plates, each plate being mounted to said closed magnetic circuit core and comprising a respective terminal extending outward from a respective one of said windows in said outer core, each said respective terminal having first and second portions and being bendable for holding said respective lead wire between said first and second portions;

each said respective terminal comprising a solder layer on at least one of said first and second portions for being melted when said respective lead wire is held between said first and second portions and for connecting said first and second portions to each other and to said respective lead wire;

said wire of said coil having a heat-meltable coating material for insulating said wire and for melting from said lead wires of said wire when said solder layer of each said terminal is melted.

2. The inductor of claim 1, in which said outer core has a generally flat inner end surface with a perimeter and a wall joining said end surface at said perimeter, said windows being defined in said wall and each said window being defined adjacent said perimeter of said end surface, each said respective plate being disposed adjacent said end surface of said outer core with said respective terminal extending from said respective window.

3. The inductor of claim 2, in which each of said plates comprises a conductive material, said inductor further comprising an insulating material for insulating each of said plates from said end surface of said outer core and from said wall around said respective window defined in said outer core.

4. The inductor of claim 3, in which each of said plates comprises a metallic material.

5. The inductor of claim 1, in which said outer core comprises first and second cores.

6. The inductor of claim 5, in which each of said first and second cores is bowl-shaped.

7. The inductor of claim 5, in which said first core is bowl-shaped and said second core is plate-shaped.

8. The inductor of claim 1, in which said outer core has an outer surface, said second portion of each said terminal being bendable in relation to said first portion, said second portion having an inner end edge disposed inward from said outer surface of said outer core.

9. The inductor of claim 1, further comprising an insulating material for filling each of said windows.

10. The inductor of claim 1, in which each of said plates comprises a metallic material.

11. The inductor of claim 1, in which said coil is adhered by adhesive to said closed magnetic circuit core and in which each plate is adhered by adhesive to said closed magnetic circuit core.

* * * * *